US007118189B2

(12) United States Patent
Kuester et al.

(10) Patent No.: US 7,118,189 B2
(45) Date of Patent: Oct. 10, 2006

(54) AUTOPURGE PRINTING SYSTEM

(75) Inventors: Kevin W. Kuester, Freeburg, IL (US); Lawrence E. Kniepkamp, Freeburg, IL (US); Terry Voss, Shiloh, IL (US); Jack Heller, Kirkwood, MO (US)

(73) Assignee: Videojet Technologies Inc., Wood Dale, IL (US)

( * ) Notice: Subject to any disclaimer, the term of this patent is extended or adjusted under 35 U.S.C. 154(b) by 302 days.

(21) Appl. No.: 10/857,551

(22) Filed: May 28, 2004

(65) Prior Publication Data

US 2005/0264620 A1 Dec. 1, 2005

(51) Int. Cl.
*B41J 2/015* (2006.01)

(52) U.S. Cl. ..... 347/21; 347/28; 347/35

(58) Field of Classification Search ..... 347/21, 347/22, 28, 34–36, 84–87
See application file for complete search history.

(56) References Cited

U.S. PATENT DOCUMENTS

| | | | | |
|---|---|---|---|---|
| 3,614,223 | A | 10/1971 | Ott | 355/30 |
| 4,080,607 | A | 3/1978 | Van Breemen et al. | 347/74 |
| 4,306,245 | A | 12/1981 | Kasugayama et al. | 347/33 |
| 4,308,546 | A | 12/1981 | Halasz | 347/68 |
| 4,314,264 | A | 2/1982 | Bok et al. | 347/89 |
| 4,318,114 | A | 3/1982 | Huliba | 347/89 |
| 4,338,613 | A | 7/1982 | Cruz-Uribe | 347/82 |
| 4,362,572 | A | 12/1982 | Wallace | 134/18 |
| 4,399,446 | A | 8/1983 | McCann et al. | 347/89 |
| 4,411,706 | A | 10/1983 | Wallace et al. | 134/37 |
| 4,432,005 | A | 2/1984 | Duffield et al. | 347/36 |
| 4,484,199 | A | 11/1984 | Watanabe | 347/69 |
| 4,498,088 | A | 2/1985 | Kanayama | 347/92 |
| 4,528,996 | A * | 7/1985 | Jones | 347/28 |
| 4,533,925 | A | 8/1985 | Tsao et al. | 347/74 |
| 4,559,543 | A | 12/1985 | Toganoh et al. | 347/38 |
| 4,591,870 | A | 5/1986 | Braun et al. | 347/25 |
| 4,591,873 | A | 5/1986 | McCann et al. | 347/25 |
| 4,600,928 | A | 7/1986 | Braun et al. | 347/27 |
| 4,623,897 | A | 11/1986 | Brown et al. | 347/21 |
| 4,626,869 | A | 12/1986 | Piatt | 347/74 |
| 4,719,791 | A | 1/1988 | Greiner et al. | 72/38 |
| 4,849,773 | A | 7/1989 | Owatari | 347/100 |
| 4,870,431 | A | 9/1989 | Sousa et al. | 347/19 |
| 4,951,066 | A | 8/1990 | Terasawa | 347/33 |

(Continued)

FOREIGN PATENT DOCUMENTS

EP WO 8606 025 A1 10/1986

(Continued)

*Primary Examiner*—Juanita D. Stephens
(74) *Attorney, Agent, or Firm*—McAndrews, Held & Malloy, Ltd.

(57) ABSTRACT

A system, including an ink supply system configured to supply ink to a printhead; and an autopurge unit configured to automatically clean the printhead. The autopurge unit includes a solvent supply in fluid communication with a solvent line, a solenoid housing, and a waste container. The solenoid housing includes a first solenoid assembly disposed within an ink line, wherein the ink line is in fluid communication with the ink supply and a first outlet that is configured to be in fluid communication with the printhead; and a second solenoid assembly disposed within a solvent line. The waste container is in fluid communication with a waste delivery line having a waste inlet. The waste inlet is configured to be in fluid communication with a waste line that is in communication with the printhead so that fluid waste from the printhead is deposited into the waste container.

23 Claims, 6 Drawing Sheets

U.S. PATENT DOCUMENTS

| | | | | |
|---|---|---|---|---|
| 4,973,992 | A | 11/1990 | Owatari | 347/85 |
| 5,008,081 | A | 4/1991 | Blau et al. | 422/64 |
| 5,103,244 | A | 4/1992 | Gast et al. | 347/33 |
| 5,138,332 | A | 8/1992 | Carlotta | 347/92 |
| 5,166,707 | A | 11/1992 | Watanabe et al. | 347/3 |
| 5,184,147 | A | 2/1993 | MacLane et al. | 347/30 |
| 5,210,550 | A | 5/1993 | Fisher et al. | 347/30 |
| 5,266,974 | A | 11/1993 | Koitabashi et al. | 347/33 |
| 5,300,958 | A | 4/1994 | Burke et al. | 347/29 |
| 5,341,162 | A | 8/1994 | Hermanson et al. | 347/92 |
| 5,365,255 | A | 11/1994 | Inoue et al. | 347/45 |
| 5,367,326 | A | 11/1994 | Pond et al. | 347/22 |
| 5,382,963 | A | 1/1995 | Pond et al. | 347/53 |
| 5,404,158 | A | 4/1995 | Carlotta et al. | 347/32 |
| 5,526,028 | A | 6/1996 | Rottman | 347/23 |
| 5,530,463 | A | 6/1996 | Nystrom et al. | 347/44 |
| 5,539,435 | A | 7/1996 | Uchida et al. | 347/33 |
| 5,559,539 | A | 9/1996 | Vo et al. | 347/33 |
| 5,572,243 | A | 11/1996 | Hermanson | 347/29 |
| 5,574,486 | A | 11/1996 | Whitlow et al. | 347/45 |
| 5,594,478 | A | 1/1997 | Matsubara et al. | 347/41 |
| 5,604,520 | A | 2/1997 | Matsubara et al. | 347/43 |
| 5,610,640 | A | 3/1997 | Anderson et al. | 347/32 |
| 5,650,806 | A | 7/1997 | Denne | 347/28 |
| 5,663,750 | A | 9/1997 | Sakuma | 347/7 |
| 5,717,446 | A | 2/1998 | Teumer et al. | 347/35 |
| 5,721,574 | A | 2/1998 | Kubby | 347/7 |
| 5,724,075 | A | 3/1998 | Smith | 347/2 |
| 5,736,996 | A | 4/1998 | Takada et al. | 347/9 |
| 5,751,305 | A | 5/1998 | Hadley | 347/19 |
| 5,757,308 | A | 5/1998 | Anderson | 342/70 |
| 5,764,265 | A | 6/1998 | Minegishi et al. | 347/108 |
| 5,786,832 | A | 7/1998 | Yamanaka et al. | 347/45 |
| 5,796,415 | A | 8/1998 | Inoue et al. | 347/45 |
| 5,801,737 | A | 9/1998 | Sato et al. | 347/86 |
| 5,818,475 | A | 10/1998 | Miyazaki et al. | 347/9 |
| 5,831,642 | A | 11/1998 | Matsubara et al. | 347/9 |
| 5,838,342 | A | 11/1998 | Takahashi et al. | 347/19 |
| 5,867,189 | A | 2/1999 | Whitlow et al. | 347/47 |
| 5,877,788 | A | 3/1999 | Haan et al. | 238/81 |
| 5,894,313 | A | 4/1999 | Mabuchi | 347/17 |
| 5,896,144 | A | 4/1999 | Kishimoto et al. | 347/30 |
| 5,896,154 | A | 4/1999 | Mitani et al. | 347/102 |
| 5,917,508 | A | 6/1999 | Lopez et al. | 347/14 |
| 5,923,347 | A | 7/1999 | Wade | 347/28 |
| 5,929,878 | A | 7/1999 | Pelletier | 347/28 |
| 5,968,312 | A | 10/1999 | Sephton | 159/47.1 |
| 6,000,792 | A | 12/1999 | Koizumi et al. | 347/89 |
| 6,024,431 | A | 2/2000 | Takashi et al. | 347/25 |
| 6,042,213 | A | 3/2000 | Hayasaki | 347/19 |
| 6,059,869 | A | 5/2000 | Fassler et al. | 106/31.27 |
| 6,070,963 | A | 6/2000 | Kamada et al. | 347/41 |
| 6,086,180 | A | 7/2000 | Sugimoto et al. | 347/14 |
| 6,094,280 | A | 7/2000 | Hayasaki et al. | 358/1.9 |
| 6,102,518 | A | 8/2000 | Taylor | 347/29 |
| 6,106,097 | A | 8/2000 | Otani et al. | 347/23 |
| 6,123,409 | A | 9/2000 | Wolf | 347/33 |
| 6,130,684 | A | 10/2000 | Premnath et al. | 347/30 |
| 6,132,026 | A | 10/2000 | Taylor et al. | 347/33 |
| 6,145,951 | A | 11/2000 | Hayasaki et al. | 347/19 |
| 6,164,751 | A | 12/2000 | Griffin et al. | 347/28 |
| 6,164,752 | A | 12/2000 | Schaefer et al. | 347/30 |
| 6,164,767 | A | 12/2000 | Nakamura et al. | 347/85 |
| 6,176,563 | B1 | 1/2001 | Anderson et al. | 347/22 |
| 6,193,350 | B1 | 2/2001 | Hadley | 347/19 |
| 6,203,135 | B1 | 3/2001 | Murcia et al. | 347/22 |
| 6,227,659 | B1 | 5/2001 | Lopez et al. | 347/68 |
| 6,231,149 | B1 | 5/2001 | Matsumoto | 347/5 |
| 6,241,337 | B1 | 6/2001 | Sharma et al. | 347/33 |
| 6,241,340 | B1 | 6/2001 | Watanabe et al. | 347/50 |
| 6,247,784 | B1 | 6/2001 | Obana et al. | 347/37 |
| 6,257,701 | B1 | 7/2001 | Otani et al. | 347/49 |
| 6,283,575 | B1 | 9/2001 | Hawkins et al. | 347/28 |
| 6,286,933 | B1 | 9/2001 | Murakami et al. | 347/47 |
| 6,293,648 | B1 | 9/2001 | Anderson | 347/29 |
| 6,299,302 | B1 | 10/2001 | DeBoer et al. | 428/32.24 |
| 6,312,090 | B1 | 11/2001 | Griffin et al. | 347/28 |
| 6,312,117 | B1 | 11/2001 | Gaasch | 347/86 |
| 6,322,186 | B1 | 11/2001 | Shimizu et al. | 347/15 |
| 6,325,482 | B1 | 12/2001 | Hayasaki et al. | 347/19 |
| 6,328,412 | B1 | 12/2001 | Taylor et al. | 347/32 |
| 6,334,662 | B1 | 1/2002 | Hollands | 347/22 |
| 6,343,850 | B1 | 2/2002 | Domagall | 347/33 |
| 6,347,858 | B1 | 2/2002 | Faisst, Jr. et al. | 347/22 |
| 6,350,012 | B1 | 2/2002 | Sarkissian et al. | 347/46 |
| 6,357,852 | B1 | 3/2002 | Premnath et al. | 347/35 |
| 6,364,449 | B1 | 4/2002 | Takahashi et al. | 347/30 |
| 6,375,303 | B1 | 4/2002 | Fukui et al. | 347/33 |
| 6,377,358 | B1 | 4/2002 | Hayasaki et al. | 347/19 |
| 6,382,767 | B1 | 5/2002 | Greive | 347/30 |
| 6,386,673 | B1 | 5/2002 | Takahashi et al. | 347/19 |
| 6,398,337 | B1 | 6/2002 | Wyble et al. | 347/30 |
| 6,406,122 | B1 | 6/2002 | Sharma et al. | 347/28 |
| 6,409,304 | B1 | 6/2002 | Taylor | 347/29 |
| 6,431,693 | B1 | 8/2002 | Masataka | 347/85 |
| 6,435,647 | B1 | 8/2002 | Faisst, Jr. et al. | 347/28 |
| 6,439,683 | B1 | 8/2002 | Matsumoto et al. | 347/15 |
| 6,446,642 | B1 | 9/2002 | Caren et al. | 134/22.18 |
| 6,454,403 | B1 | 9/2002 | Takada et al. | 347/100 |
| 6,457,802 | B1 | 10/2002 | Jackson | 347/35 |
| 6,471,321 | B1 | 10/2002 | Aono | 347/14 |
| 6,478,402 | B1 | 11/2002 | Greive | 347/30 |
| 6,481,822 | B1 | 11/2002 | Murcia et al. | 347/22 |
| 6,481,824 | B1 | 11/2002 | Hayakawa et al. | 347/24 |
| 6,491,371 | B1 | 12/2002 | Berg et al. | 347/36 |
| 6,494,560 | B1 | 12/2002 | Seshimo et al. | 347/23 |
| 6,511,151 | B1 | 1/2003 | Griffin et al. | 347/28 |
| 6,511,534 | B1 | 1/2003 | Mishina et al. | 106/31.33 |
| 6,513,903 | B1 | 2/2003 | Sharma et al. | 347/28 |
| 6,517,188 | B1 | 2/2003 | Hawkins et al. | 347/34 |
| 6,523,930 | B1 | 2/2003 | Griffin et al. | 347/28 |
| 6,530,634 | B1 | 3/2003 | Hara | 347/7 |
| 6,540,330 | B1 | 4/2003 | Kubota et al. | 347/45 |
| 6,550,885 | B1 | 4/2003 | Matsumoto et al. | 347/19 |
| 6,557,985 | B1 | 5/2003 | Hosono et al. | 347/70 |
| 6,572,215 | B1 | 6/2003 | Sharma | 347/28 |
| 6,575,556 | B1 | 6/2003 | Eremity et al. | 347/28 |
| 6,575,567 | B1 | 6/2003 | Matsumoto et al. | 384/132 |
| 6,585,348 | B1 | 7/2003 | Reed et al. | 347/29 |
| 6,588,876 | B1 | 7/2003 | Taylor et al. | 347/32 |
| 6,592,940 | B1 | 7/2003 | Myhill et al. | 347/45 |
| 6,595,618 | B1 | 7/2003 | Roy et al. | 347/32 |
| 6,604,813 | B1 | 8/2003 | Green | 347/47 |
| 6,610,165 | B1 | 8/2003 | Myhill et al. | 156/230 |
| 2001/0012027 | A1 | 8/2001 | Murcia et al. | 347/22 |
| 2001/0022603 | A1 | 9/2001 | Masataka | 347/85 |
| 2001/0043250 | A1 | 11/2001 | Faisst | 347/22 |
| 2002/0005873 | A1 | 1/2002 | Suzuki | 347/27 |
| 2002/0015070 | A1 | 2/2002 | Taylor et al. | 347/32 |
| 2002/0018107 | A1 | 2/2002 | Yakushigawa et al. | 347/100 |
| 2002/0036672 | A1 | 3/2002 | Courtney et al. | 347/30 |
| 2002/0080207 | A1 | 6/2002 | Kand et al. | 347/30 |
| 2002/0085058 | A1 | 7/2002 | Griffin et al. | 347/28 |
| 2002/0085059 | A1 | 7/2002 | Sharma et al. | 347/28 |
| 2002/0093557 | A1 | 7/2002 | Takuhara et al. | 347/100 |
| 2002/0105564 | A1 | 8/2002 | Matsumoto et al. | 347/85 |
| 2002/0108564 | A1 | 8/2002 | Gruenwald et al. | 118/125 |
| 2002/0122096 | A1 | 9/2002 | Masataka et al. | 347/45 |
| 2002/0130918 | A1 | 9/2002 | Hayakawa et al. | 347/29 |
| 2002/0145645 | A1 | 10/2002 | Aono | 347/48 |
| 2002/0158925 | A1 | 10/2002 | Hara | 347/7 |
| 2002/0163562 | A1 | 11/2002 | Tanaka et al. | 347/65 |
| 2002/0167569 | A1 | 11/2002 | Hosono et al. | 347/70 |
| 2002/0186270 | A1 | 12/2002 | Sharma | 347/28 |

| | | | | |
|---|---|---|---|---|
| 2002/0186281 | A1 | 12/2002 | Yamamoto et al. | 347/63 |
| 2003/0007026 | A1 | 1/2003 | Matsumoto et al. | 347/19 |
| 2003/0011656 | A1 | 1/2003 | Caren et al. | 347/28 |
| 2003/0016267 | A1 | 1/2003 | Green | 347/41 |
| 2003/0025766 | A1 | 2/2003 | Tanaka et al. | 347/65 |
| 2003/0051800 | A1 | 3/2003 | Myhill et al. | 156/230 |
| 2003/0052101 | A1 | 3/2003 | Gu et al. | 219/121.71 |
| 2003/0081050 | A1 | 5/2003 | Reed et al. | 347/29 |
| 2003/0128249 | A1 | 7/2003 | Booth | 347/22 |
| 2003/0128250 | A1 | 7/2003 | Booth | 347/22 |
| 2003/0132990 | A1 | 7/2003 | Mitani | 347/63 |
| 2003/0202034 | A1 | 10/2003 | Lodal et al. | 347/33 |
| 2003/0207081 | A1 | 11/2003 | Myhill et al. | 428/137 |

FOREIGN PATENT DOCUMENTS

| | | | |
|---|---|---|---|
| EP | WO 8606 026 | A1 | 10/1986 |
| EP | 0 271 470 | A2 | 6/1988 |
| EP | 0 316 198 | A2 | 5/1989 |
| EP | 0 317 172 | A2 | 5/1989 |
| EP | 0 414 513 | A2 | 5/1989 |
| EP | 0 442 471 | A1 | 8/1991 |
| EP | 0 442 485 | A2 | 8/1991 |
| EP | 0 452 157 | A1 | 10/1991 |
| EP | 0 465 260 | A2 | 1/1992 |
| EP | 0 468 712 | A3 | 5/1992 |
| EP | 0 484 100 | A1 | 5/1992 |
| EP | 0 508 114 | A1 | 10/1992 |
| EP | 0 271 470 | B1 | 11/1992 |
| EP | 0 525 988 | A3 | 2/1993 |
| EP | 0 526 186 | A3 | 5/1993 |
| EP | 0 558 219 | A3 | 10/1993 |
| EP | 0 317 172 | B1 | 5/1994 |
| EP | 0 597 674 | A2 | 5/1994 |
| EP | 0 556 011 | A3 | 9/1994 |
| EP | 0 600 735 | A3 | 11/1994 |
| EP | 0 626 265 | A3 | 3/1995 |
| EP | 0 645 245 | A1 | 3/1995 |
| EP | 0 645 245 | B1 | 3/1995 |
| EP | 0 585 901 | A3 | 5/1995 |
| EP | 0 468 995 | B1 | 6/1995 |
| EP | 0 665 105 | A1 | 8/1995 |
| EP | 0 348 234 | B1 | 10/1995 |
| EP | 0 452 157 | B1 | 10/1995 |
| EP | 0 465 260 | B1 | 10/1995 |
| EP | 0 484 100 | B1 | 10/1995 |
| EP | 0 684 139 | A1 | 11/1995 |
| EP | 0 442 471 | B1 | 1/1996 |
| EP | 0 420 469 | B1 | 3/1996 |
| EP | 0 709 192 | A3 | 7/1996 |
| EP | 0 508 114 | B1 | 9/1996 |
| EP | 0 558 219 | B1 | 10/1996 |
| EP | 0 499 432 | B1 | 4/1997 |
| EP | 0 495 649 | B1 | 8/1997 |
| EP | 0 583 016 | B1 | 9/1997 |
| EP | 0 745 485 | A3 | 10/1997 |
| EP | 0 771 659 | A3 | 10/1997 |
| EP | 0 665 105 | B1 | 11/1997 |
| EP | 0 817 113 | A2 | 1/1998 |
| EP | 0 761 452 | A3 | 5/1998 |
| EP | 0 729 115 | A3 | 10/1998 |
| EP | 0 822 082 | A3 | 10/1998 |
| EP | 0 924 084 | A1 | 6/1999 |
| EP | 0 932 300 | A2 | 7/1999 |
| EP | 0 936 071 | A1 | 8/1999 |
| EP | 0 942 585 | A2 | 9/1999 |
| EP | 0 942 591 | A1 | 9/1999 |
| EP | 0 585 901 | B1 | 12/1999 |
| EP | 10 626 265 | B1 | 12/1999 |
| EP | 0 925 925 | A3 | 1/2000 |
| EP | 0 933 212 | A3 | 1/2000 |
| EP | 0 987 113 | A2 | 3/2000 |
| EP | 0 933 215 | A3 | 4/2000 |
| EP | 0 988 975 | A3 | 4/2000 |
| EP | 0 997 298 | A2 | 5/2000 |
| EP | 1 004 642 | A2 | 5/2000 |
| EP | 0 561 406 | B1 | 6/2000 |
| EP | 0 556 011 | B1 | 7/2000 |
| EP | 1 018 430 | A1 | 7/2000 |
| EP | 1 013 448 | A3 | 8/2000 |
| EP | 1 024 003 | A3 | 8/2000 |
| EP | 1 029 683 | A1 | 8/2000 |
| EP | 1 038 677 | A1 | 9/2000 |
| EP | 1 078 749 | A2 | 2/2001 |
| EP | 1 085 061 | A2 | 3/2001 |
| EP | 1 088 664 | A | 4/2001 |
| EP | 1 088 862 | A1 | 4/2001 |
| EP | 1 088 863 | A1 | 4/2001 |
| EP | 1 090 761 | A2 | 4/2001 |
| EP | 1 090 762 | A2 | 4/2001 |
| EP | 1 110 733 | A1 | 6/2001 |
| EP | 1 129 855 | A1 | 9/2001 |
| EP | 1 142 967 | A2 | 10/2001 |
| EP | 1 147 897 | A2 | 10/2001 |
| EP | 1 162 072 | A1 | 12/2001 |
| EP | 1 164 018 | A1 | 12/2001 |
| EP | 1 167 043 | A1 | 1/2002 |
| EP | 1 167 472 | A1 | 1/2002 |
| EP | 1 170 130 | A1 | 1/2002 |
| EP | 0 709 192 | B1 | 2/2002 |
| EP | 1 188 804 | A1 | 3/2002 |
| EP | 1 219 433 | A | 7/2002 |
| EP | 1 223 035 | A1 | 7/2002 |
| EP | 1 024 003 | B1 | 10/2002 |
| EP | 1 249 349 | A1 | 10/2002 |
| EP | 0 761 452 | B1 | 12/2002 |
| EP | 1 262 324 | A1 | 12/2002 |
| EP | 0 822 082 | B1 | 1/2003 |
| EP | 1 273 449 | A2 | 1/2003 |
| EP | 0 988 975 | B1 | 3/2003 |
| EP | 1 293 345 | A2 | 3/2003 |
| EP | 0 745 485 | B1 | 4/2003 |
| EP | 1 308 289 | A2 | 5/2003 |
| EP | 1 095 773 | B1 | 7/2003 |
| EP | 0 817 113 | B1 | 9/2003 |
| EP | 0 936 071 | B1 | 9/2003 |
| EP | 1 356 943 | A2 | 10/2003 |
| JP | 59 012857 | A | 1/1984 |
| JP | 6302 2656 | A2 | 1/1988 |
| JP | 6311 2154 | A2 | 5/1988 |
| JP | 1134 2631 | A2 | 12/1999 |
| JP | 20000 94702 | A2 | 4/2000 |
| JP | 2000 198214 | A2 | 7/2000 |
| JP | 2001 096737 | A2 | 4/2001 |
| WO | WO 8606 031 | A1 | 10/1986 |
| WO | WO 901 2691 | A1 | 11/1990 |
| WO | WO 9806 583 | A1 | 2/1998 |
| WO | WO 9845 122 | A1 | 10/1998 |
| WO | WO 0201 929 | A2 | 1/2002 |
| WO | WO 02/36347 | A2 | 5/2002 |
| WO | WO 03/026897 | A1 | 4/2003 |

* cited by examiner

AUTOPURGE PRINTING SYSTEM

BACKGROUND OF THE INVENTION

Embodiments of the present invention generally relate to an inkjet printer, and more particularly, to an inkjet printer having an autopurge system configured to automatically clean a printhead.

Drop-on-demand inkjet printers include a printhead having a binary array having a large number of print orifices. During printing, ink is ejected through particular orifices based on the nature of a character to be printed on a suitable medium. Ink is not ejected through every orifice at all times during a printing process. Rather, only select orifices are utilized at any one time depending on the nature of the character to be printed. Generally, drop-on-demand inkjet printers differ from continuous inkjet printers, in which a constant stream of drops are passed between charged electrodes, because ink is not ejected through all of the orifices during a particular printing process.

Due to the fact that ink is not ejected through all of the orifices during a printing process, the orifices that are less frequently used may accumulate dust, dirt, dried ink, and other waste materials over time. Certain orifices may become crusted over, restricted, or blocked because of infrequent use, or simply because the printing system may be idle for an extended period of time. Additionally, the printface, in general, may also accumulate debris, such as dust, dirt, paper debris, and the like.

In order to purge the orifices and printhead of impurities and other waste products, the printhead is typically manually cleaned. For example, the printhead may be sprayed with a cleaning solvent, and then wiped off.

Further, some printing systems automatically purge the orifices of waste materials by periodically passing ink therethrough, in order to break up obstructions within the orifices. In general, however, a user still needs to collect the ink and waste materials after they have been passed through the orifices. Such a process, however, is inefficient and time-consuming.

Thus, a need exists for an efficient system and method of purging a printhead of impurities. Further, a need exists for a self-contained waste removal and collection system.

SUMMARY OF THE INVENTION

Certain embodiments of the present invention provide an inkjet printing system that includes a printhead, a solvent supply, and a first solenoid assembly. The printhead has an orifice plate and a solvent port disposed above the orifice plate. The printhead also includes a vacuum port disposed below the orifice plate. The vacuum port is configured to collect solvent waste fluid.

The solvent supply is in fluid communication with the solvent port through a solvent supply line. The first solenoid assembly is disposed within the solvent supply line, and is engaged to close a portion of the solvent supply line such that solvent within the solvent supply line that is downstream from the first solenoid assembly is pulsed through the solvent supply line. The solvent that is pulsed through the solvent supply line pulses out the solvent port and passes over the orifice plate, thereby removing waste materials from the orifice plate to form solvent waste fluid.

The inkjet printing system may also include an ink supply in fluid communication with the orifice plate through an ink supply line, and a second solenoid assembly disposed within the ink supply line. The second solenoid assembly is engaged to close a portion of the ink supply line such that ink within the ink supply line that is downstream from the second solenoid assembly is pulsed through the ink supply line. The ink that is pulsed through the ink supply line pulses out orifices within the orifice plate. The ink pulsed through the orifices removes ink waste materials from the orifices, thereby forming ink waste fluid that passes over the orifice plate.

The system also includes a waste removal line and a waste container. The waste removal line is in fluid communication with the vacuum port and the waste container such that the solvent and ink waste fluids pass from the vacuum port to the waste container by way of the waste removal line.

Certain embodiments of the present invention also provide a system including an ink supply system configured to supply ink to a printhead, and an autopurge unit configured to automatically clean the printhead. The autopurge unit includes a solvent supply in fluid communication with a solvent line, a solenoid housing, and a waste container.

The solenoid housing includes a first solenoid assembly disposed within an ink line and a second solenoid assembly disposed within a solvent line. The ink line is in fluid communication with the ink supply and a first outlet that is configured to be in fluid communication with the printhead; and a second solenoid assembly disposed within a solvent line. The first and second solenoid assemblies are configured to constrict proximate portions (i.e., portions that are proximate the first and second assemblies) of the ink and solvent lines, respectively.

The waste container is in fluid communication with a waste delivery line having a waste inlet. The waste inlet is configured to be in fluid communication with a waste line that is in communication with the printhead so that fluid waste from the printhead is deposited into the waste container. The system also includes a vacuum adapted to draw the fluid waste into the waste container.

Certain embodiments of the present invention also provide a method of automatically cleaning a printhead of an inkjet printer. The method includes engaging a first solenoid assembly to constrict a solvent supply line, pulsing solvent through a portion of the solvent supply line that is downstream from the first solenoid assembly due to said engaging, and running the solvent over an orifice plate of the printhead through a solvent port that is in fluid communication with the solvent supply line, wherein the running removes debris from the orifice plate. The method may also include opening a downstream check valve due to the engaging step so that solvent may pass through the downstream check valve, and closing an upstream check valve due to the engaging step so that solvent may not pass through the upstream check valve.

The method also includes suctioning the solvent and debris into a vacuum port located below the orifice plate, and passing the solvent and debris into a waste removal line having a first end that is fluidly connected to the vacuum port and a second end that is fluidly connected to a waste container, wherein the solvent and debris are deposited into the waste container.

Additionally, the method may include engaging a second solenoid assembly to constrict an ink supply line, pulsing ink through a portion of the ink supply line that is downstream from the second solenoid assembly due to said engaging; and pulsing ink through orifices of the orifice plate that is in fluid communication with the ink supply line so that waste is removed from the orifices. The ink is suctioned into the vacuum port.

Figure 1:
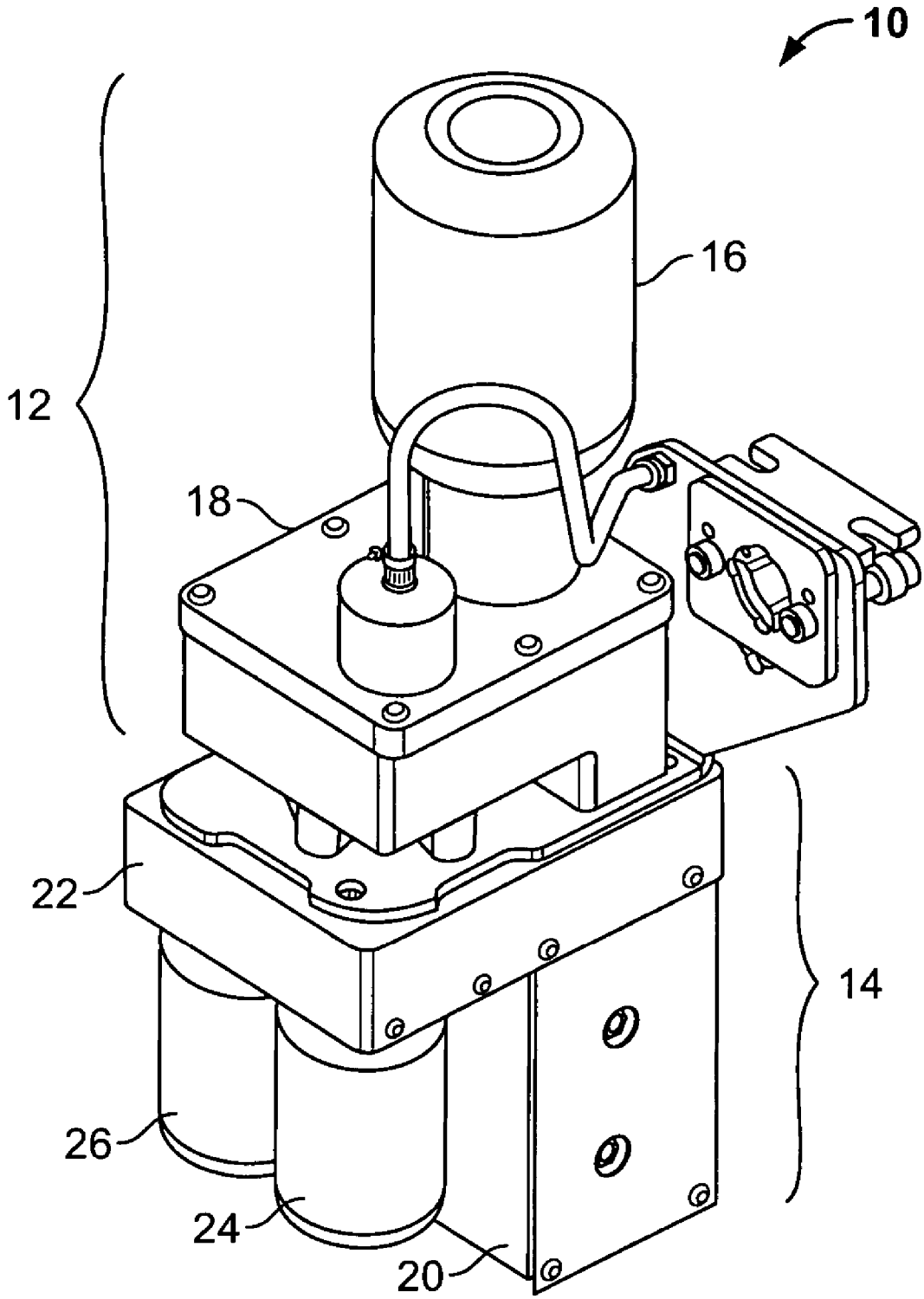
FIG. 1 illustrates an isometric view of an autopurge ink system, according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates an isometric view of an autopurge ink system 10, according to an embodiment of the present invention. The system 10 may be used with a drop-on-demand inkjet printer. The system 10 includes an ink supply system 12 mounted on an autopurge unit 14. The ink supply system 12 includes an ink bottle 16 in communication with an ink reservoir 18, such that ink passes from the ink bottle 16 into the ink reservoir 18. The autopurge unit 14 includes a solenoid housing 20 connected to a ink supply system support housing 22. A solvent supply bottle 24 and a waste container 26 are removably mounted to the ink supply system support housing 22. For example, the solvent supply bottle 24 and the waste container 26 may threadably engage corresponding reciprocal threaded engagement ports (not shown) located on said ink supply system support housing 22. Thus, the solvent supply bottle 24 and the waste container 26 may be threaded onto and removed from the ink supply system support housing 22.

In operation, ink flows from the ink supply system 12 into the autopurge system 14 through appropriate tubing (not shown). The ink flows through the solenoid housing 20 and into tubing (not shown) that allows the ink to pass out of the autopurge ink system 10. Similarly, solvent passes from the solvent supply bottle 24 into tubing (not shown) through the ink supply support housing 22 and into the solenoid housing 20. The solvent then passes out of the autopurge system 10 through appropriate tubing (not shown).

Figure 2:
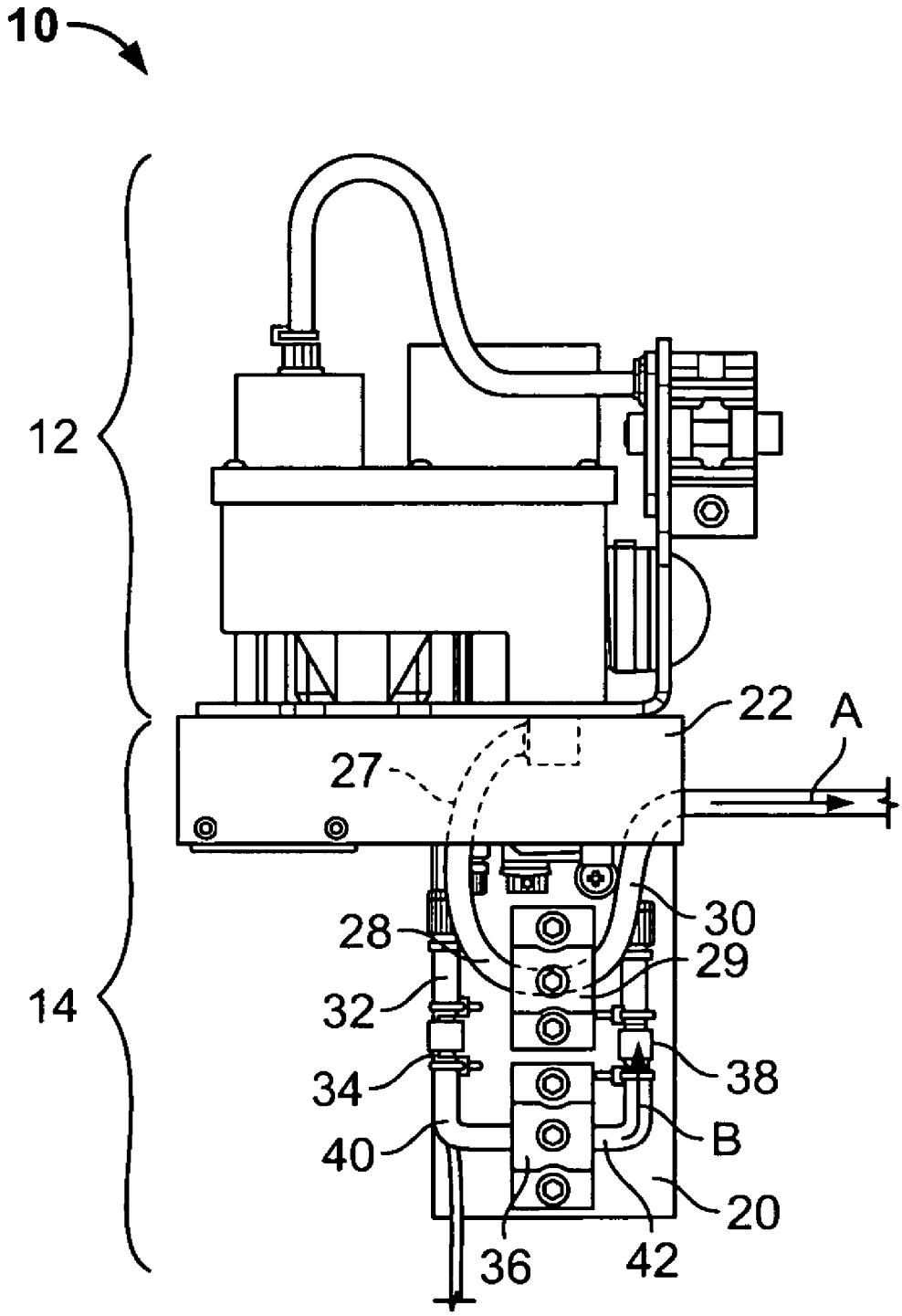
FIG. 2 illustrates a side view of an autopurge ink system, according to an embodiment of the present invention.

FIG. 2 illustrates a side view of the autopurge ink system 10. As shown in FIG. 2, ink passes into the ink supply support housing 22 by way of an ink supply line 27, including tubing, that passes into the solenoid housing 20. The ink supply line 27 is in fluid communication with the ink supply system 12. A solenoid assembly 29 is disposed within the ink supply line 27, and is configured to squeeze, crimp, crush, pinch, or otherwise constrict the ink supply line 27 in order to restrict ink flow from a pre-entry position 28 to an exit position 30. The solenoid assembly 29 may be a solenoid-operated pinch valve, or any other type of device that is configured to constrict or squeeze the ink supply line 27. Additionally, when the solenoid assembly 29 is actuated or engaged, thereby constricting the ink supply line 27, ink in the ink supply line 27 that has already passed through the solenoid assembly 29 is pushed at the exit position 30 through the remaining portion of the ink supply line 27 in the direction of arrow A.

Check valves may be disposed within the ink supply line 27 before and after the solenoid assembly 29. One check valve may be disposed within the ink supply line 27 upstream of the solenoid assembly 29, while the other check valve may be disposed downstream the solenoid assembly 29. For example, the downstream check valve may be disposed within an ink line within a printhead. The check valves within the ink supply line may be operated by way of a manual purge bulb to create a pumping action within the ink line.

Solvent passes into the solenoid housing 20 through the ink supply support housing 22 by way of a solvent supply line 32, which includes tubing. The solvent supply line 32 is in fluid communication with the solvent bottle 16 (shown in FIG. 1). An upstream check valve 34 is disposed within the solvent supply line 32 upstream from a solenoid assembly 36. The solenoid assembly 36 may be a solenoid-operated pinch valve, or any other such device that is configured to constrict or squeeze the solvent supply line 32. A downstream check valve 38 is disposed within the solvent supply line 32 downstream from the solenoid assembly 36. When the solenoid assembly 36 is actuated or engaged to constrict or squeeze the solvent supply line 32, solvent flow from a pre-entry position 40 to an exit position 42 is restricted. Additionally, upon actuation of the solenoid assembly 36, the upstream check valve 34 closes and the downstream check valve 38 opens up and allows the solvent to pulse or flow forward in the direction of arrow B. When the solenoid assembly 36 is not actuated, the upstream check valve 34 opens and allows solvent to fill the solvent supply line 32 up to the downstream check valve 38, which is closed, thereby restricting solvent from flowing therethrough. When the solenoid assembly 36 is actuated, thereby squeezing the solvent supply line 32 proximate the solenoid assembly 36 and forcing the downstream check valve 38 open, the fluid filled in the solvent supply line 32 from the solenoid assembly 36 to the downstream check valve 38 flows through the downstream check valve 38 in the direction of arrow B. Alternatively, the solvent supply line 32 may not include the check valves 34 and 38.

Figure 3:
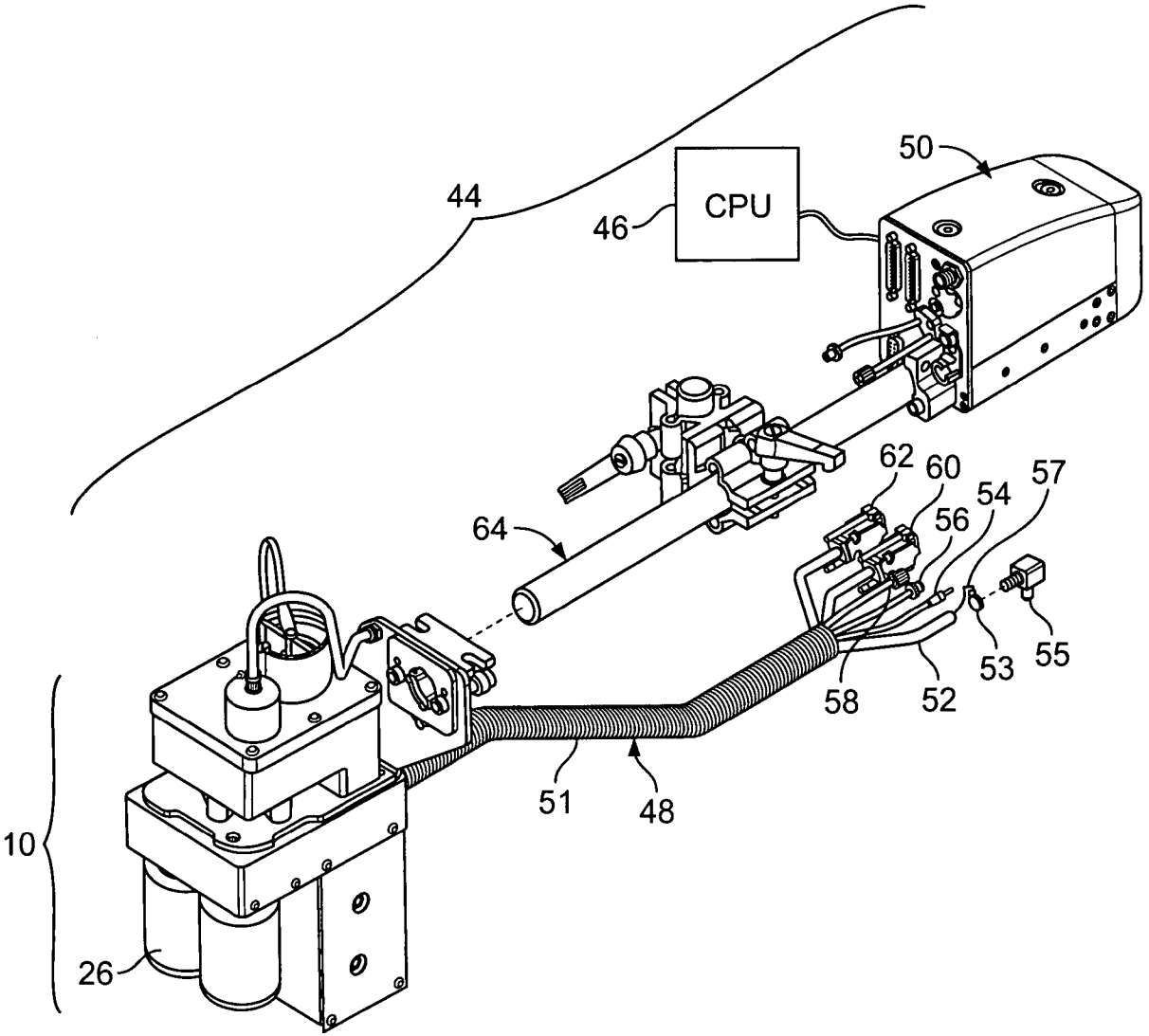
FIG. 3 illustrates an isometric view of portions of a printing system, according to an embodiment of the present invention.

FIG. 3 illustrates an isometric view of portions of a printing system 44, according to an embodiment of the present invention. The printing system 44 includes a central processing unit (CPU) 46 in electrical communication with the printing system 44, including the autopurge ink system 10. The CPU 46 controls the operation, for example the timing, of the printing system 44. A connection line 48 is connected to the autopurge ink system 10 and bundles and houses various tubing and electrical wiring from the autopurge ink system 10 to a printhead 50. The connection line 48 includes a flexible tube 51 that houses an ink line 52 having a tie wrap 53 and an ink line fitting 55 located at a distal end 57 of the ink line 52. The ink line 52 also includes a proximal end (not shown) that is integrally formed with, or connected to, the ink supply line 27 (shown in FIG. 2). Further, the connection line 48 includes a low ink alarm cable 54, a waste line 56, a solvent line 58 having an end (not shown) that is integrally formed or connected to the solvent supply line 32, a photocell link cable 60, and a photocell extension cable 62. The waste line 56 includes a proximal end (not shown) that is integrally formed with, or connected to appropriate tubing (not shown) within the autopurge system 10 that is in fluid communication with the waste container 26. The connection line 48 may be housed within a rigid tube 64.

Figure 4:
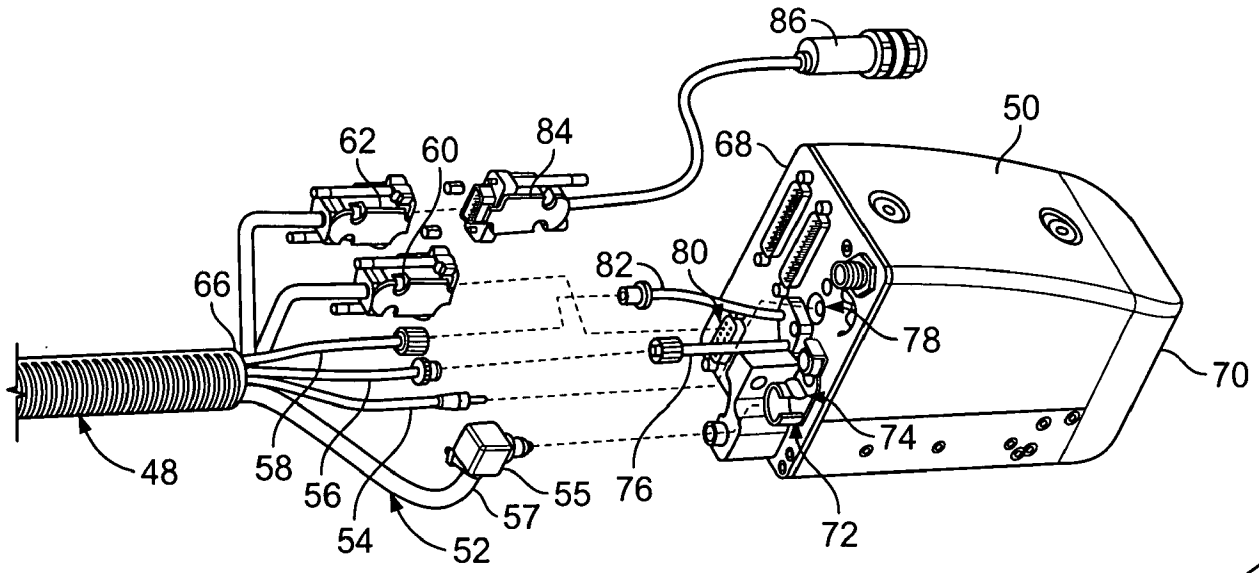
FIG. 4 illustrates an isometric view of a printhead and connection line, according to an embodiment of the present invention.

FIG. 4 illustrates an isometric view of the printhead 50 and a distal end 66 of the connection line 48. The printhead 50 includes a connection interface 68 and a printface 70. The connection interface 68 includes an ink fitting 72 having a quick disconnect button 74, a waste connection 76, a low ink alarm jack 78, a photocell connector 80, and a solvent connection line 82.

As shown in FIG. 4, the distal end 57 of the ink line 52 mates with the ink fitting 72, thereby providing a fluid connection for ink to pass from the autopurge system 10 to the printhead 50 through the connection line 48. The printhead 50 also includes appropriate tubing (not shown) that allows ink to pass from the ink fitting 72 to the printface 70.

The low ink alarm cable 54 mates with the low ink alarm jack 78, thereby providing a connection between the printhead 50 and the autopurge system 10. Electrical signals sensed by a low ink sensing device (not shown) positioned within the printing system 44 are passed through the low ink alarm jack 78 through the low ink alarm cable 54, and eventually onto the CPU 46 (shown in FIG. 3) for appropriate processing The waste line 56 connects to the waste connection 76. As such, waste fluid may pass from the printhead 50 to the waste line 56 through the waste connection 76. The waste fluid then passes from the waste line 56 to appropriate tubing (not shown) positioned within the autopurge system 10 (shown with respect to FIGS. 1–3) and into the waste container 26 (shown, e.g., in FIG. 3). The autopurge system 10 may include a vacuum pump that suctions waste fluid from the printhead 50 into the waste container 26, as described above.

The solvent line 58 connects to the solvent connection line 82 of the printhead 50. Thus, solvent may pass from the autopurge system 10 to the printhead 50 through the connection of the solvent line 58 and the solvent connection line 82. Solvent passes through appropriate tubing (not shown) within the printhead 50 to the printface 70.

The photocell link 60 connects to the photocell connector 80. Additionally, the photocell extension cable 62 is configured to mate with a reciprocal connector 84 of a photocell 86.

Figure 5:
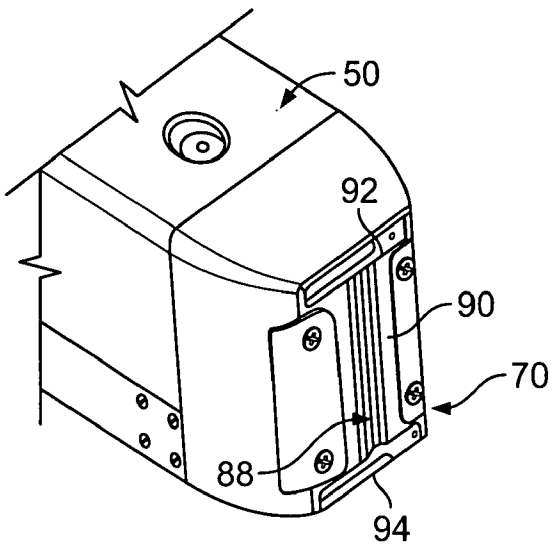
FIG. 5 illustrates an isometric view of a printface of a printhead, according to an embodiment of the present invention.

FIG. 5 illustrates an isometric view of the printface 70 of the printhead 50. The printface 70 includes an ink orifice plate 88 having an ink orifice array 90, a solvent port 92, and a vacuum port 94. During printing, ink pulses through orifices within the ink orifice array 90 onto a suitable medium at appropriate locations and times, which are determined by the nature of the character(s) to be printed. That is, the printhead 50 is utilized with a drop-on-demand printing system.

Ink may run or drool down the orifice plate 88 in order to clean the orifices located within orifice plate 88. Ink runs, or drools, down the orifice plate 88 due to gravity and the suctioning action of the vacuum port 94. The vacuum port 94 is in fluid communication with the waste line 56 (shown in FIGS. 3 and 4), so that excess ink may be vacuumed through the waste line 56 to the autopurge system 10.

Additionally, solvent may pulse from the solvent port 92 and run or droll over the orifice plate 88. The solvent that drools over the orifice plate 88 collects waste materials, such as dust, paper debris, dry ink, and the like, and is collected at vacuum port 94. That is, waste materials, whether they are picked up by ink or solvent that drools over the orifice plate 88, are suctioned into the waste line 56 by way of the vacuum port 94.

Figure 6:
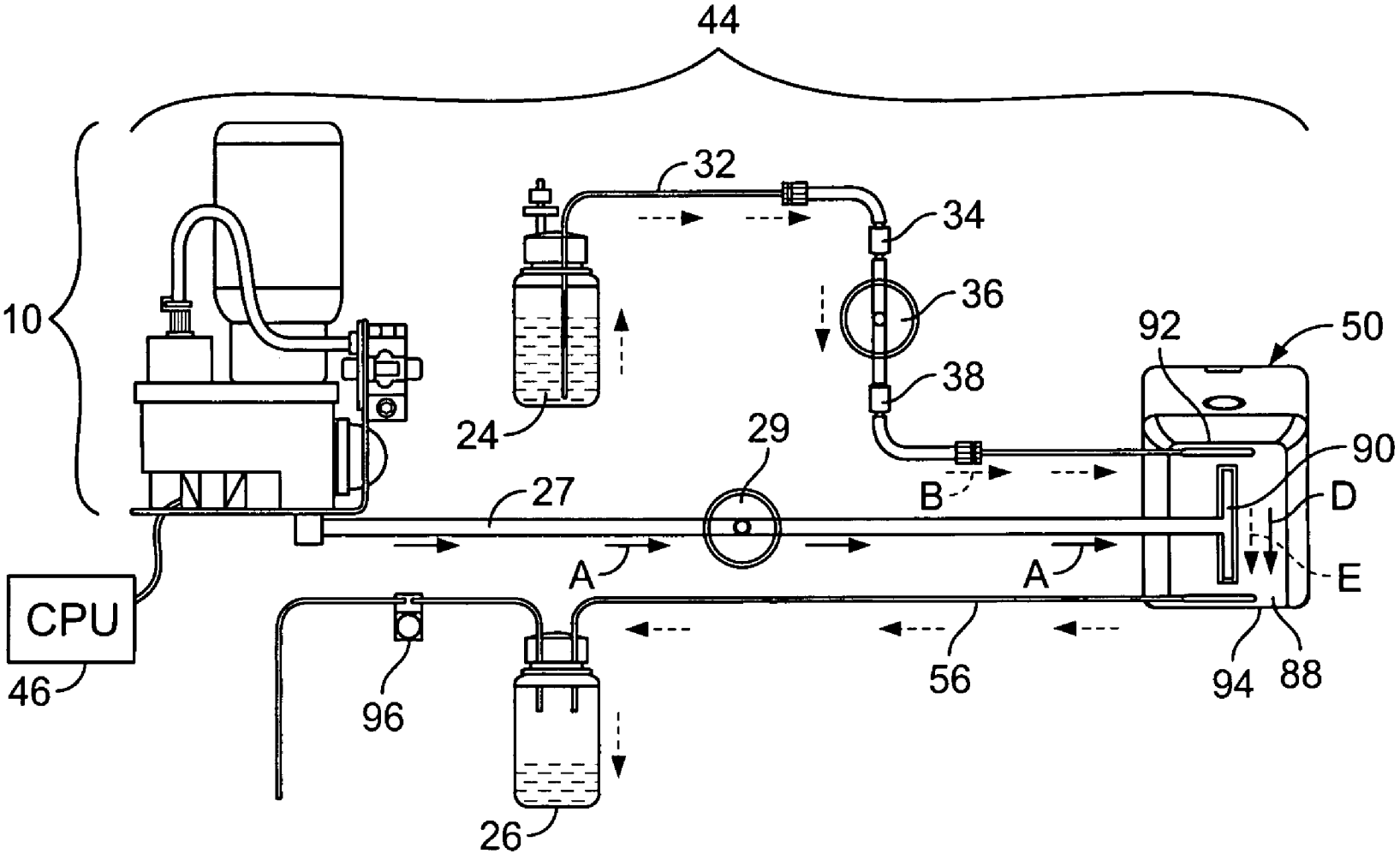
FIG. 6 illustrates a schematic representation of a printing system, according to an embodiment of the present invention.

FIG. 6 illustrates a schematic representation of the printing system 44. Ink is supplied to the printhead 50 through the ink supply line 27 in the direction of arrows A. The solenoid assembly 29 is engaged to contract or squeeze the ink supply line 27 in conjunction with check valves, thereby squeezing ink through the ink supply line 27 downstream from the solenoid assembly 29, and out orifices within the ink orifice array 90. Because the ink is squeezed through the ink supply line 27, the ink pulses out of the orifices of the ink orifice array 90 and drools or runs over the ink orifice plate 88. As the ink picks up waste materials on the orifice plate array 88, it drools down the orifice plate 88 in the direction of arrow D, until it is suctioned into the vacuum port 94.

Similarly, solvent passes through the solvent supply line 32 onto the printhead 50 through the action of the solenoid assembly 36. As the solenoid assembly 36 is engaged, it constricts the solvent supply line 32. Consequently, the downstream check valve 38 is forced open and solvent within the solvent supply line 32 up to that point is squeezed through the portion of the solvent supply line 32 that is downstream from the downstream check valve 38, and into the solvent port 92. When the solenoid assembly 36 is engaged, the upstream check valve 34 closes thereby precluding solvent from passing therethrough. Upon disengagement of the solenoid assembly 36, the downstream check valve 38 closes, thereby preventing solvent from passing therethrough, while the upstream check valve 34 opens, thereby allowing solvent to fill the solvent supply line 32 up to the downstream check valve 38.

As solvent is squeezed through the solvent supply line 32 in the direction of arrows B, the solvent is passed to the solvent port 92. The squeezing action of the solenoid assembly 36 causes solvent to pulse out of the solvent port 92. As the solvent pulses through the solvent port 92, it drools or runs down the orifice plate 88 in the direction of arrow E, thereby collecting waste materials. The solvent and collected waste materials are then suctioned into the vacuum port 94.

In general, ink is pulsed through the orifices of the orifice array 90 in an ink waste removal process as described above in order to remove crusted materials, dried ink, and the like from the orifice plate 88. Further, solvent is pulsed through the solvent port 92 to drool down the orifice plate 88 in a solvent waste removal process, as described above, in order to remove external debris, such as paper, dust, ink deposits, and the like. Waste material, including ink, solvent, and collected waste products (such as dried ink deposits, dust, and the like) are suctioned through the waste line 56 and into the waste container 26 by way of a vacuum 96. The vacuum 96 may be housed within the autopurge system 10, or it may optionally be separate and distinct therefrom.

As discussed above, during a cleaning process, ink and solvent drool, or run, over the orifice plate 88 in order to collect and/or remove waste materials therefrom. The ink and solvent, however, do not spit or jet from the orifice plate 88. In general, ink is pulsed through the orifices of the orifice array 90 in order to clean the orifices of minor debris. The ink and minor debris drool over the orifice plate 88 and are suctioned into the vacuum port 92. Additionally, solvent is pulsed through the solvent port 92 to wash excess ink and other debris from the orifice plate 88 as it drools over the orifice plate 88. The waste material that is suctioned into the vacuum port 94 is then collected in the waste container 26.

The CPU 46 or other suitable controller may be programmed to clean the orifice plate 88 through the ink waste removal process and/or the solvent waste removal process, as described above. In particular, the CPU 46 may direct only an ink waste removal process, or a solvent waste removal process at any one time. Alternatively, both processes may be performed simultaneously.

Figure 7:
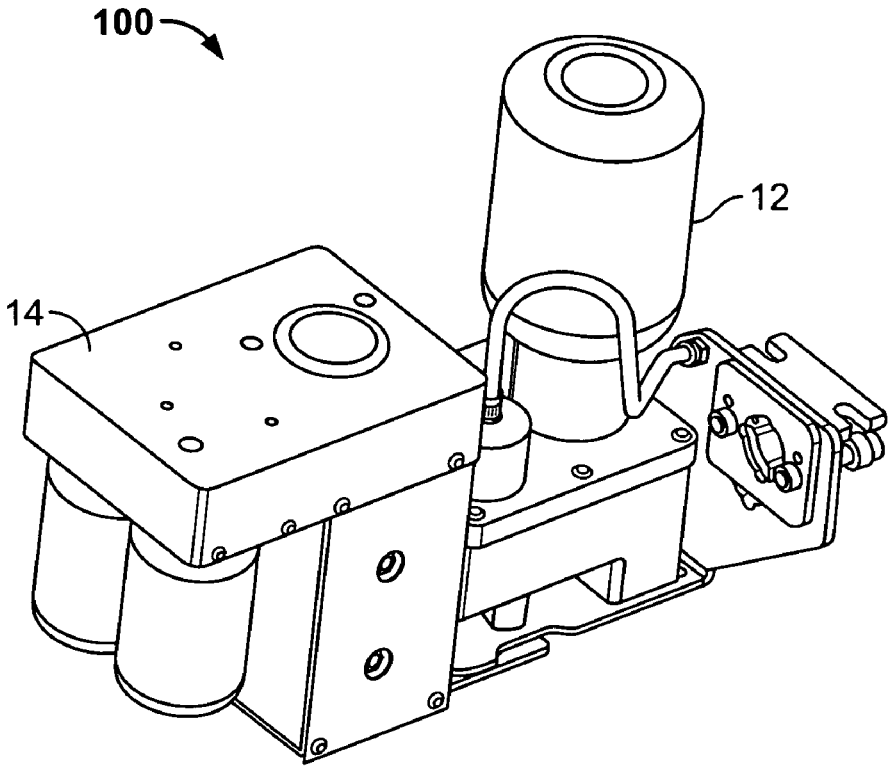
FIG. 7 illustrates an isometric view of an autopurge ink system, according to an alternative embodiment of the present invention.

FIG. 7 illustrates an isometric view of an autopurge ink system 100, according to an alternative embodiment of the present invention. The autopurge ink system 100 includes ink supply system 12 mounted to a side of, instead of over, the autopurge unit 14. Overall, the autopurge unit 14 and the ink supply system 12 may be oriented in various configurations. Operation of the autopurge ink system 100 is similar to that described above with respect to the autopurge unit 10.

Figure 8:
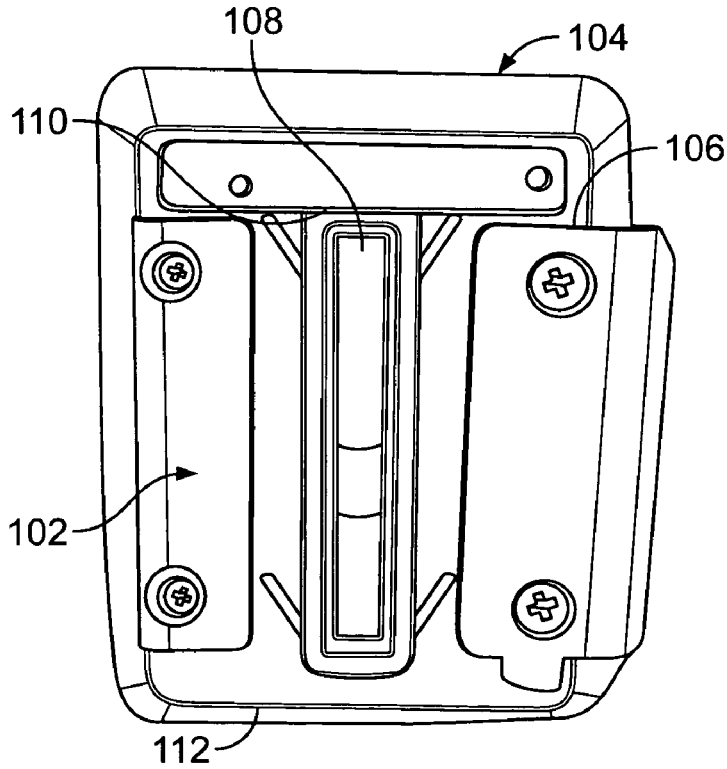
FIG. 8 illustrates a front view of a printface of a printhead, according to an alternative embodiment of the present invention.

FIG. 8 illustrates a front view of a printface 102 of a printhead 104, according to an alternative embodiment of the present invention. The printface 102 includes an ink orifice plate 106 having an ink orifice array 108, a solvent port 110, and a vacuum port 112. In general, the printhead 104 is similar to the printhead 50, except that vacuum port 112 is wider and generally larger than the vacuum port 94 shown, for example, in FIG. 5. As such, the vacuum port 112 is capable of receiving large debris build-up, and is less likely to smear ink on a passing substrate.

Embodiments of the present invention provide an efficient system and method of purging a printhead of impurities. In particular, certain embodiments of the present invention provide a self-contained waste removal and collection system. Further, the solenoid assemblies provide a system and method of pulsing ink and solvent to the printhead, without the need for expensive fluid flow systems and the like. Additionally, embodiments of the present invention provide a system for automatically purging and cleaning an array of a drop-on-demand printer.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. An inkjet printing system, comprising:

a printhead having an orifice plate and a solvent port disposed above said orifice plate;

a solvent supply in fluid communication with said solvent port through a solvent supply line; and a first solenoid assembly disposed within said solvent supply line, said first solenoid assembly being engaged to close a portion of said solvent supply line such that solvent within said solvent supply line that is downstream from said first solenoid assembly is pulsed through said solvent supply line, wherein the solvent that is pulsed through said solvent supply line pulses out said solvent port and passes over said orifice plate, and wherein said solvent removes waste materials from said orifice plate, thereby forming solvent waste fluid.

2. The inkjet printing system of claim 1, wherein said printhead further comprises a vacuum port disposed below said orifice plate, said vacuum port configured to collect the solvent waste fluid.

3. The inkjet printing system of claim 2, further comprising:

an ink supply in fluid communication with said orifice plate through an ink supply line; and a second solenoid assembly disposed within said ink supply line, said second solenoid assembly being engaged to close a portion of said ink supply line such that ink within said ink supply line that is downstream from said second solenoid assembly is pulsed through said ink supply line, wherein the ink that is pulsed through said ink supply line pulses out orifices within said orifice plate, wherein said ink removes ink waste materials from said orifices, thereby forming ink waste fluid that passes over said orifice plate, and wherein said vacuum port collects the ink waste fluid.

4. The inkjet printing system of claim 3, further comprising a waste removal line and a waste container, said waste removal line being in fluid communication with said vacuum port and said waste container such that the solvent and ink waste fluids pass from the vacuum port to said waste container by way of said waste removal line.

5. The inkjet printing system of claim 4, further comprising a vacuum disposed within said waste removal line, wherein said vacuum is configured to draw the ink and waste fluids through said waste removal line and into said waster container.

6. The inkjet printing system of claim 1, wherein said solvent supply line further comprises a first check valve positioned upstream from said first solenoid assembly, and a second check valve positioned downstream from said first solenoid assembly.

7. The inkjet printing system of claim 1, wherein the inkjet printing system is a drop-on-demand inkjet printing system.

8. The inkjet printing system of claim 1, wherein when said first solenoid assembly is engaged to squeeze said portion of said solvent supply line, thereby closing said portion of said solvent supply line.

9. A system, comprising:

an ink supply system configured to supply ink to a printhead through an ink line; and an autopurge unit configured to automatically clean the printhead, said autopurge unit comprising:

a solvent supply in fluid communication with a solvent line;

a solenoid housing having (i) a first solenoid assembly disposed within the ink line, wherein the ink line is in fluid communication with the ink supply and a first outlet that is configured to be in fluid communication with the printhead; and (ii) a second solenoid assembly disposed within the solvent line, wherein the solvent line is in fluid communication with the solvent supply and a second outlet, which is configured to be in fluid communication with the printhead; and a waste container in fluid communication with a waste delivery line having a waste inlet, wherein the waste inlet is configured to be in fluid communication with a waste line that is in communication with the printhead so that fluid waste from the printhead is deposited into the waste container.

10. The system of claim 9, further comprising a vacuum adapted to draw the fluid waste into said waste container.

11. The system of claim 9, wherein said first and second solenoid assemblies are configured to constrict proximate portions of said ink and solvent lines, respectively.

12. The system of claim 9, wherein said ink and solvent lines each further comprise a first check valve positioned upstream from said first and second solenoid assemblies, respectively, and a second check valve positioned downstream from said first and second solenoid assemblies, respectively.

13. The system of claim 9, wherein said ink supply system is mounted on top of said autopurge unit.

14. The system of claim 9, wherein said ink supply system further comprises an ink bottle mounted to, and in fluid communication with, an ink reservoir.

15. The system of claim 9, wherein said autopurge unit further comprises an ink supply support housing, said solenoid housing mounted underneath said ink supply support housing, and said solvent supply and said waste container being removably secured to said ink supply housing.

16. A method of automatically cleaning a printhead of an inkjet printer, the method comprising:

engaging a first solenoid assembly to constrict a solvent supply line;

squeezing solvent through a portion of the solvent supply line that is downstream from the first solenoid assembly due to said engaging; and pulsing the solvent from a solvent port, which is in fluid communication with the solvent supply line, causing the solvent to run over an orifice plate of the printhead so that debris is removed from the orifice plate.

17. The method of claim 16, further comprising suctioning the solvent and debris into a vacuum port located below the orifice plate.

18. The method of claim 17, further comprising passing the solvent and debris into a waste removal line having a first end that is fluidly connected to the vacuum port and a second end that is fluidly connected to a waste container, wherein the solvent and debris are deposited into the waste container.

19. The method of claim 16, further comprising:

engaging a second solenoid assembly to constrict an ink supply line;

squeezing ink through a portion of the ink supply line that is downstream from the second solenoid assembly due to said engaging; and pulsing ink through orifices of the orifice plate that is in fluid communication with the ink supply line so that waste is removed from the orifices.

20. The method of claim 19, wherein said pulsing further comprises drooling the ink over the orifice plate.

21. The method of claim 20, further comprising suctioning the ink and waste into a vacuum port located below the orifice plate.

22. The method of claim 21, further comprising passing the ink and waste into a waste removal line having a first end that is fluidly connected to the vacuum port and a second end that is fluidly connected to a waste container, wherein the ink and waste are deposited into the waste container.

23. The method of claim 16, further comprising:

opening a downstream check valve due to said engaging so that solvent may pass through the downstream check valve; and closing an upstream check valve due to said engaging so that solvent may not pass through the upstream check valve.

* * * * *